US008708663B1

(12) United States Patent
Varani et al.

(10) Patent No.: US 8,708,663 B1
(45) Date of Patent: Apr. 29, 2014

(54) FUGITIVE GAS CAPTURE

(76) Inventors: Frederick T. Varani, Denver, CO (US); Paul Bertram Trost, Golden, CO (US)

( * ) Notice: Subject to any disclaimer, the term of this patent is extended or adjusted under 35 U.S.C. 154(b) by 0 days.

(21) Appl. No.: 13/533,741

(22) Filed: Jun. 26, 2012

Related U.S. Application Data

(63) Continuation-in-part of application No. 12/142,902, filed on Jun. 20, 2008, now Pat. No. 8,206,124.

(60) Provisional application No. 60/936,180, filed on Jun. 20, 2007.

(51) Int. Cl.
*F04B 49/02* (2006.01)
*E21B 43/12* (2006.01)

(52) U.S. Cl.
USPC ..... 417/44.7; 166/53; 137/565.17

(58) Field of Classification Search
USPC ..... 417/34, 364, 53, 44.7; 175/207; 137/565.34, 565.17; 166/53, 267, 166/75.12; 138/30; 123/2, 3, 518, 519, 516, 123/447, 196 S, 196 R
See application file for complete search history.

(56) References Cited

U.S. PATENT DOCUMENTS

| | | | | |
|---|---|---|---|---|
| 947,437 | A | | 1/1910 | Ellis |
| 1,327,999 | A | | 1/1920 | Hill |
| 1,705,792 | A | | 3/1929 | Vignere |
| 2,459,317 | A | | 1/1949 | Granberg |
| 2,634,681 | A | | 4/1953 | Rowell |
| 2,895,305 | A | | 7/1959 | Reed |
| 2,947,379 | A | | 8/1960 | Aubrey |
| 3,234,579 | A | | 2/1966 | Brown |
| 3,247,798 | A | | 4/1966 | Glasgow et al. |
| 3,326,089 | A | * | 6/1967 | Machado ..... 92/5 R |
| 3,450,162 | A | | 6/1969 | Mercier |
| 3,493,001 | A | | 2/1970 | Bevandich |
| 4,422,301 | A | | 12/1983 | Watt et al. |
| 4,579,565 | A | | 4/1986 | Heath |
| 4,730,634 | A | * | 3/1988 | Russell ..... 95/22 |
| 5,042,582 | A | * | 8/1991 | Rajewski ..... 166/267 |
| 5,135,360 | A | | 8/1992 | Anderson et al. |
| 5,139,390 | A | | 8/1992 | Rajewski |
| 5,367,882 | A | | 11/1994 | Lievens et al. |
| 5,651,389 | A | | 7/1997 | Anderson |
| 6,209,651 | B1 | | 4/2001 | Knight |
| 7,326,285 | B2 | | 2/2008 | Chowdhury |
| 7,350,581 | B2 | * | 4/2008 | Wynn ..... 166/370 |
| 2010/0158717 | A1 | | 6/2010 | Vogt |

* cited by examiner

*Primary Examiner* — Charles Freay
*Assistant Examiner* — Nathan Zollinger
(74) *Attorney, Agent, or Firm* — HolzerIPLaw, PC

(57) ABSTRACT

A fugitive gas capture system includes a variable volume gas storage assembly (e.g., a bag) that expands and deflates between a first position and a second position, respectively, where the positions influence control of a switch coupled to a throttle on a gas engine that powers a compressor or coupled to a valve input to a gas booster compressor. The compressor is coupled to an output pipeline to provide the compressed gas in liquid or gas form to a pipeline under consistent pressure. Alternatively, the compressed gas may be on-site in a separator, in a heater treater, for various controls, as engine fuel, or with any other energy source employed on site, e.g., electric power from offgas vapors used to generate on-site electricity.

20 Claims, 2 Drawing Sheets

FUGITIVE GAS CAPTURE

CROSS-REFERENCE TO RELATED APPLICATIONS

The present application is a continuation-in-part application of U.S. patent application Ser. No. 12/142,902, entitled "Oil-Gas Condensate Tank Vapor Collection, Storage, and Recovery System" and filed on Jun. 20, 2008, which is specifically incorporated by reference for all that it discloses and teaches.

The present application also claims benefit to U.S. Provisional Application No. 60/936,180, filed on Jun. 20, 2007, which is specifically incorporated by reference for all that it discloses and teaches.

BACKGROUND

Oil and natural gas production and/or storage facilities typically employ tanks for storing large volumes of oil and natural gas in liquid or gaseous form. Such tanks are also referred to as "production tanks" in the industry. Such tanks may also be used to store other chemicals.

Production tanks are often a source of hydrocarbon vapors or gases (collectively referred to herein as "fugitive gases" or "gases") emitting into the atmosphere. Government agencies, such as the Colorado Department of Health, have begun to adopt regulations limiting emissions from production tanks Depending on temperature, color of production tank, orientation to the sun, and gravity of the containing liquids, coupled with the normal separator operations, the amount of gas may vary from minimal to in excess of 4 mcfd (million cubic feet per day). Typically, these gases have a very high BTU (British Thermal Unit) content. Capture and beneficial usage of these gases, as opposed to flaring, is both economical and environmentally advantageous.

Further, gas in production tanks that are open to the atmosphere (e.g., are allowed to breathe) may reach explosive limits within the production tank, such as when the gas pressure decreases below the UEL (upper explosive limits) of the gas. This condition can present a safety hazard.

SUMMARY

Implementations of the systems described herein limit air and/or oxygen leakage into the production tank when gauging and/or emptying the tank and provide a constant reservoir-type storage system by utilizing a variable volume, at a substantially constant pressure, to minimize the compressor cycling and by simultaneously accommodating rapid influxes of liquids and/or gases into the tank.

In this manner, when the separator dumps, or the plunger lift system adds significant volumes of volatile oil-condensate and the associated highly volatile gases, the surge of gases is accommodated by the system. The gases are temporarily stored in a variable volume storage assembly (e.g., a bag, a floating bell gasometer), which accommodates hydrocarbons. The variable volume storage assembly collapses, e.g., like plastic bag or an accordion, when very little gas is present but expands rapidly, under minimal pressure (e.g., a column pressure of approximately 1 to 2 inches), to contain a surge of gases. As the variable volume storage assembly expands, the variable volume storage assembly actuates a switch that controls a compressor. The compressor, in turn, compresses the captured gas and outputs it to a pipeline. As the variable volume storage assembly decompresses and shrinks, a switch is activated to turn off the compressor. Thus the present system allows the oil storage tank to operate at a constant pressure, while the variable volume storage assembly accommodates the variable gas volume.

In addition, in one implementation, the variable volume storage assembly has the capability of backflowing into the product tank to maintain a hydrocarbon vapor level above the UEL. The system limits air and/or oxygen leakage in the production tank to maintain this safety level, while still allowing proper venting.

Implementations described and claimed herein address the foregoing problems by providing a variable volume storage assembly that expands and deflates between a first position and a second position, respectively, where the positions influence control of a switch coupled to a throttle on a gas engine that powers a compressor or coupled to a valve input to a gas booster compressor. The compressor is coupled to an output pipeline to provide the compressed gases in liquid or gas form to a pipeline under consistent pressure.

The compressed output can be input as influent to a pipeline for sale or reuse, injected or re-injected into the well bore, etc. In addition, the compressed gases can be used for an oil-water separator, for a heater treater, and/or as an energy source for Ajax-type engines (in place of purchased propane). Further, the compressed gases can be used for on-site produced water evaporation, thereby cutting water disposal costs. In addition, the system can operate without electoral service to the tank battery, which is convenient and eliminates the labor and costs of installing an electrical source for the tank. Payback for the system is site specific; however, for a condensate production tank, payback is projected at 2.5 years. In general, implementations of the system can capture fugitive gases from the production tank and reduce the escape of gases and the associated BTU content into the environment.

Other implementations are also described and recited herein.

BRIEF DESCRIPTIONS OF THE DRAWINGS

DETAILED DESCRIPTIONS

Figure 1:
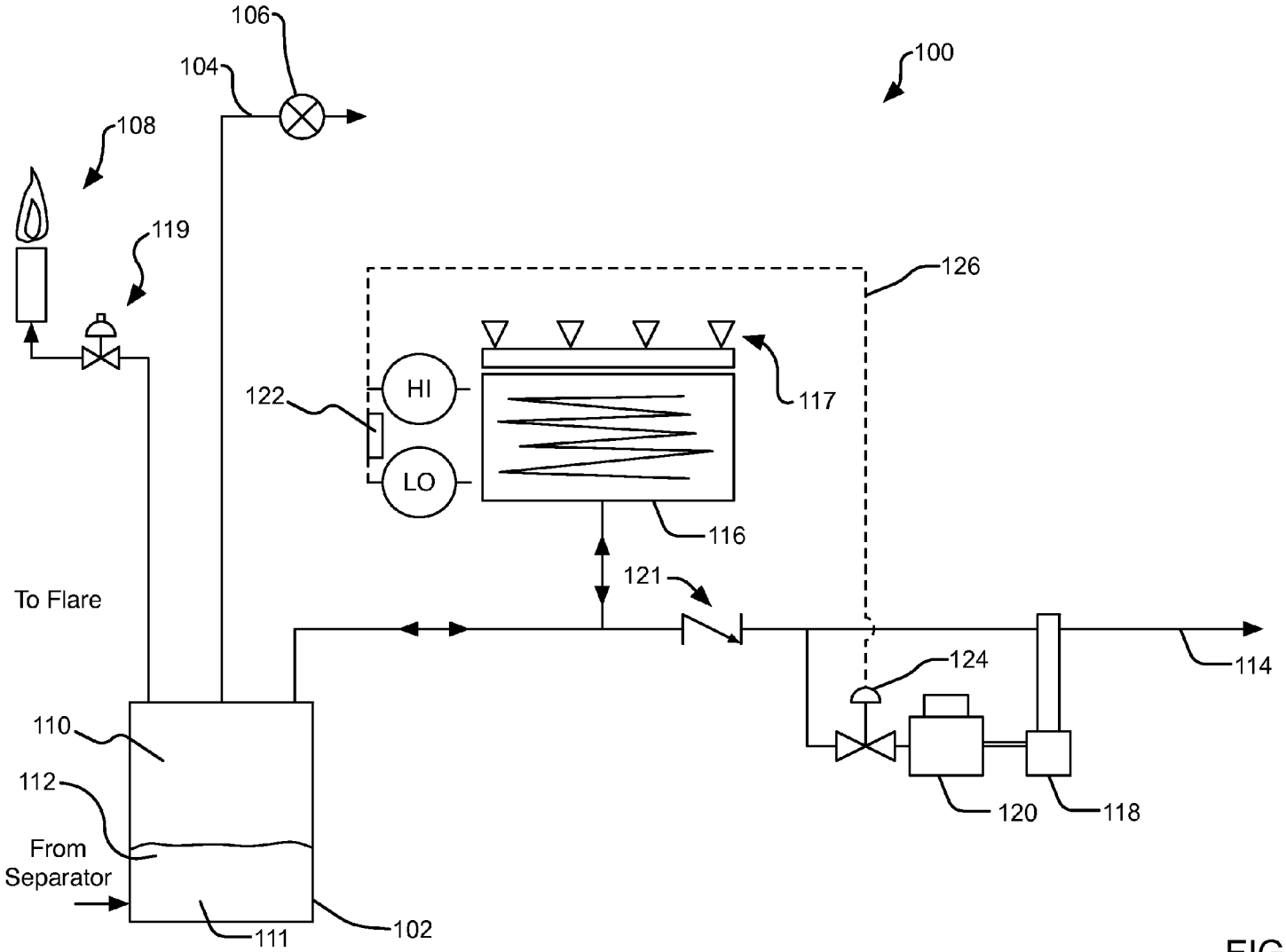
FIG. 1 illustrates an example fugitive gas capture system.

FIG. 1 illustrates an example fugitive gas capture system 100. A chemical collection tank 102 (e.g., a production tank) includes a tank vent 104 with a pressure release valve 106 and a pressure vacuum release 108, which vents flammable gas to a flare stack. The chemical collection tank 102 receives liquid and/or gas from a separator (not shown). In some cases, oil 111 and/or other liquid chemicals collect at the bottom of the tank 102. The tank headspace 110 holds various headspace gases (e.g., consisting of methane and higher hydrocarbon gases), which may be economically recovered using the described system. In various implementations of the described technology, these gases may be captured and re-injected into an output pipeline 114 under pressure.

The system 100 incorporates a variable volume storage assembly 116, which in one implementation is in the form of a gas bag, to collect excess headspace gas from the tank headspace 110 by expanding under increased pressure from the tank 102 when liquid and/or gas is input to the tank 102 from the separator. Other implementations may include alternative types of variable volume storage assemblies including, without limitation, a bellows assembly. The variable volume storage assembly 116 collapses when liquids and/or gases are removed from the tank 102 or when the gases captured in the variable volume storage assembly 116 are removed from the variable volume storage assembly 116 and output under pressure to the pipeline 114. In the illustrated implementation, a light pressure on the variable volume storage assembly is provided by weights 117, although other pressure sources may be employed.

The implementation shown in FIG. 1 includes an engine-powered compressor 118. A gas-powered engine 120 is shown as powering the compressor 118, although alternative power sources may be employed, such as an electric engine, a gasoline powered engine, etc. The engine 120 powers the compressor 118, which is in line with the variable volume storage assembly 116. The engine 120 uses a small portion of the captured gas to operate the compressor 118, which pressurizes the gas from the tank headspace 110 to pipeline pressure for sale and reuse.

A control system couples the variable volume storage assembly 116 with the compressor 118 such that the level of expansion or contraction of the variable volume storage assembly 116 controls or influences the level of compression provided by the compressor 118. In the illustrated implementation, a position indicator switch 122 detects the position of the variable volume storage assembly 116 and uses that position to operate a throttle 124 on the engine 120. When the variable volume storage assembly 116 is expanded (e.g., to a high position), which indicates a large amount of captured gas in the variable volume storage assembly 116, the engine 120 operates at high speed and causes the compressor to compress the excess captured gas into the pipeline 114. When the variable volume storage assembly 116 is contracted (e.g., to a low position), which indicates a depletion of the captured gas in the variable volume storage assembly 116, the engine 120 operates at low-speed (or turns off), and little or no captured gas is compressed into the pipeline 114. In one implementation, the control system consists of a plurality of mechanical linkages 126 (e.g., chain links), which couple the variable volume storage assembly 116 to the throttle 124 and therefore control the speed of the engine 120 and the compression of the compressor 118. A check valve 121 allows captured gas to be pulled from the headspace 110 and the variable volume storage assembly 116 for compression into the pipeline 114 and prevents the captured gas from flowing back to the headspace 110 or the variable volume storage assembly 116. It should be understood that although mechanical linkages are described as a component of the control system, other communicative links may be employed including cables, pulleys, a series of electrical switches, wired or wireless master-slave controls, optical controls and communication links, etc.

In some implementations, the compressor 118 is powered by an electric engine. However, a well site may not have access to an electrical supply, so alternative engines may be employed. In one implementation, an engine may be powered by a portion of the captured gas extracted from the headspace 110 and/or the variable volume storage assembly 116.

Figure 2:
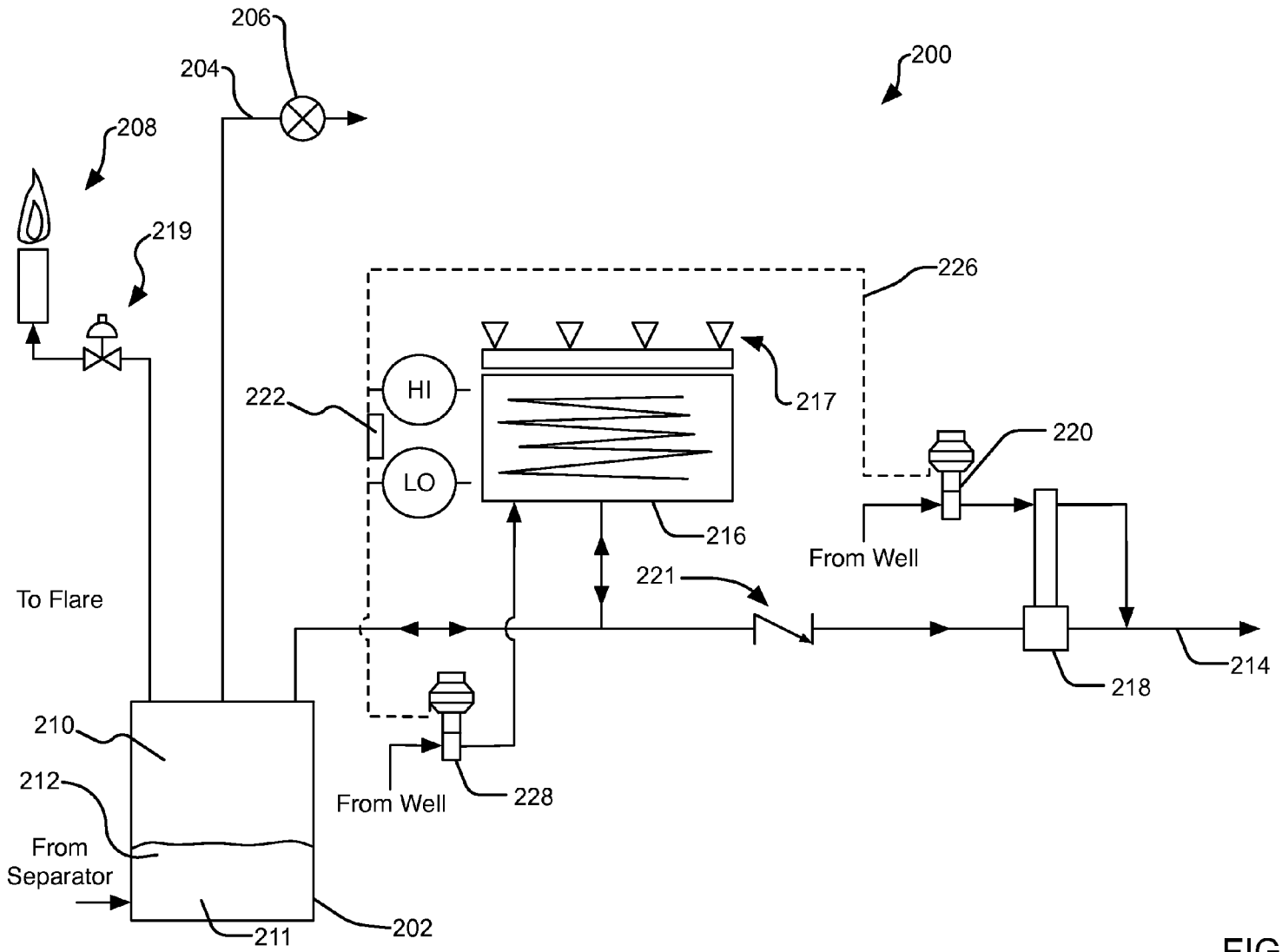
FIG. 2 illustrates an alternative example of a fugitive gas capture system.

FIG. 2 illustrates an alternative example of a fugitive gas capture system 200. A chemical collection tank (e.g., a production tank) 202 includes a tank vent 204 with a pressure release valve 206 and a pressure vacuum release 208, which vents flammable gas to a flare stack. The chemical collection tank 202 receives liquid and/or gas from a separator (not shown). In some cases, oil 211 and/or other liquid chemicals collect at the bottom of the tank 202. The tank headspace 210 holds various headspace gases (e.g., consisting of methane and higher hydrocarbon gases), which may be economically recovered using the described system. In various implementations of the described technology, these gases may be captured and re-injected into an output pipeline 214 under pressure.

The system 200 incorporates a variable volume storage assembly 216, which in one implementation is in the form of a gas bag, to collect excess headspace gas from the tank headspace 210 by expanding under increased pressure from the tank 202 when liquid and/or gas is input to the tank 202 from the separator. Other implementations may include alternative types of variable volume storage assemblies including, without limitation, a bellows assembly. The variable volume storage assembly 216 collapses when liquids and/or gas are removed from the tank 202 or when the gases captured in the variable volume storage assembly 216 are removed from the variable volume storage assembly 216 and output under pressure to the pipeline 214 for sale and/or reuse. In the illustrated implementation, a light pressure on the variable volume storage assembly is provided by weights 217, although other pressure sources may be employed.

The implementation shown in FIG. 2 includes a gas booster compressor 218 to compress the captured gas at the well site without an electrical supply. The gas booster compressor 218 uses the wellhead gas pressure (typically within the range of 3 psig to 660 psig, e.g., 200 psig) to power a small cylinder within the gas booster 218, which strokes a larger cylinder connected directly the power cylinder of the gas booster compressor 218. The gas booster compressor 218 compresses the captured gas from the headspace 210 and the variable volume storage assembly 216 into the pipeline 214 for sale or reuse at pressures ranging from 5-300 psig, or alternatively, to pressure of 10-80 psig for use in the on-site separation. A check valve 221 allows captured gas to be pulled from the headspace 210 and the variable volume storage assembly 216 for compression into the pipeline 214 and prevents the captured gas from flowing back to the headspace 210 or the variable volume storage assembly 216.

A control system couples the variable volume storage assembly 216 with the compressor 218 such that the level of expansion or contraction of the variable volume storage assembly 216 controls or influences the level of compression provided by the compressor 218. In the illustrated implementation, a position indicator switch 222 detects the position of the variable volume storage assembly 216 and uses that position to operate a solenoid 220, which feeds the pressurized wellhead gas to the gas booster compressor 218. When the variable volume storage assembly 216 is expanded (e.g., to a high position), which indicates a large amount of captured gas in the variable volume storage assembly 216, the solenoid 220 provides a high wellhead gas pressure to the gas booster compressor 218 to compress the excess captured gas into the pipeline 214. When the variable volume storage assembly 216 is contracted (e.g., to a low position), which indicates a depletion of the captured gas in the variable volume storage assembly 216, the solenoid 220 provides little or no wellhead gas pressure to the gas booster compressor 218 and therefore little or no captured gas is compressed into the pipeline 214. In one implementation, the control system consists of a plurality of mechanical linkages 226 (e.g., chain links), which couple the variable volume storage assembly 216 to the solenoid 220 and therefore control the supplied wellhead pressure and the compression of the compressor 218. A check valve 221 allows captured gas to be pulled from the headspace 210 and the variable volume storage assembly 216 for compression into the pipeline 214 and prevents the captured gas from flowing back to the headspace 210 or the variable volume storage assembly 216. It should be understood that although mechanical linkages are described as a component of the control system, other communicative links may be employed including cables, pulleys, a series of electrical switches, wired or wireless master-slave controls, optical controls and communication links, etc.

In one implementation, another solenoid 228 receives pressurized wellhead gas (e.g., at approximately 200 psig). When the captured gas in the variable volume storage assembly 216 is depleted, the solenoid 228 may be controlled by the linkage 226 to direct the wellhead gas into the variable volume storage assembly 216 to prevent it from going completely empty. A similar subsystem may be implemented in the system 100 shown in FIG. 1.

Furthermore, a safety feature, as shown in FIG. 1 as back pressure regulator 119 and in FIG. 2 as back pressure regulator 219, may be employed to allow captured gas to vent headspace gas that exceeds the design limits of the variable volume storage assembly (e.g., exceeds safe pressure levels). Excess pressure in variable volume storage assembly can be directed back into the headspace 210 of the production tank and then may be released through a back pressure regulator 219 to a flare stack. In addition, the venting on the production tank may be configured (e.g., set at 3 inches of gas pressure) to maintain a headspace pressure that exceeds the upper explosive limits (UEL) of the gas, thereby minimizing or eliminating the probability of ignition from lightening and other ignition sources.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A fugitive gas capture system comprising:

an inflatable variable volume storage assembly having a first state corresponding to a first position and a second state corresponding to a second position, wherein the first state represents a greater volume of captured gas being stored within the variable volume storage assembly than the second state, the first state and the second state being under substantially constant pressure, and the captured gas being captured from headspace of a production tank; and a control system coupled to the variable volume storage assembly and configured to detect the first position and the second position and to control a compressor that extracts and compresses the captured gas from the variable volume storage assembly and directs the compressed gas under pressure to an output pipeline.

2. The fugitive gas capture system of claim 1 wherein the control system comprises:

a position indicator switch coupled to the variable volume storage assembly and configured to control the compressor based on the detected position of the variable volume storage assembly.

3. The fugitive gas capture system of claim 2 wherein the control system comprises:

communicative links coupling the position indicator switch to the compressor based on the detected position of the variable volume storage assembly.

4. The fugitive gas capture system of claim 1 wherein the variable volume storage assembly is configured to inflate to the first position and to deflate to the second position based on pressure from headspace gas received from the production tank.

5. The fugitive gas capture system of claim 1 further comprising:

an outlet to a flare stack having an inline back pressure regulator for venting excess pressure from the variable volume storage assembly to the flare stack.

6. A system comprising:

an inflatable variable volume storage assembly having a first state corresponding to a first position and a second state corresponding to a second position, wherein the first state represents a greater volume of captured gas being stored within the variable volume storage assembly than the second state, the first state and the second state being under substantially constant pressure; and a control system coupled to the variable volume storage assembly and configured to detect the first position and the second position and to control a compressor that extracts and compresses the captured gas from the variable volume storage assembly and directs the compressed gas under pressure to an output.

7. The system of claim 6 wherein the control system comprises:

a position indicator switch coupled to the variable volume storage assembly and configured to control the compressor based on the detected position of the variable volume storage assembly.

8. The system of claim 7 wherein the control system comprises:

a communicative link coupling the position indicator switch to the compressor based on the detected position of the variable volume storage assembly.

9. The system of claim 6 wherein the variable volume storage assembly receives headspace gas from a production tank.

10. The system of claim 6 wherein the variable volume storage assembly is configured to inflate to the first position and to deflate to the second position based on pressure from headspace gas received from a production tank.

11. The system of claim 6 wherein the output of the compressor comprises:

an output pipeline or an on-site usage system.

12. The system of claim 6 further comprising:

an outlet to a flare stack having an inline back pressure regulator for venting excess pressure from the variable volume storage assembly to the flare stack.

13. A method comprising:

operating an inflatable variable volume storage assembly to receive captured gas, the variable volume storage assembly having a first state corresponding to a first position and a second state corresponding to a second position, wherein the first state represents a greater volume of the captured gas being stored within the variable volume storage assembly than the second state, the first state and the second state being under substantially constant pressure;

directly communicating the states of the variable volume storage assembly over time to a compressor control based the detected positions of the variable volume storage assembly;

extracting under compressor control to an output the captured gas from the variable volume storage assembly; and compressing under compressor control the extracted gas from the variable volume storage assembly based on the communicated states of the variable volume storage assembly.

14. The method of claim 13 wherein the positions are detected by a position indicator switch coupled to the variable volume storage assembly.

15. The method of claim 14 wherein the compressing operations are controlled based on the detected position of the variable volume storage assembly.

16. The method of claim 13 wherein the captured gas is received as headspace gas from a production tank.

17. The method of claim 13 wherein the variable volume storage assembly inflates to the first position and deflates to the second position based on pressure from headspace gas received from a production tank.

18. The method of claim 13 wherein the output includes an output pipeline or an on-site usage system.

19. The method of claim 13 further comprising:

venting excess pressure from the variable volume storage assembly through an outlet having an inline back pressure regulator.

20. The fugitive gas capture system of claim 1 further comprising:

an outlet having an inline back pressure regulator for venting excess pressure from the variable volume storage assembly.

* * * * *

UNITED STATES PATENT AND TRADEMARK OFFICE

CERTIFICATE OF CORRECTION

PATENT NO. : 8,708,663 B1
APPLICATION NO. : 13/533741
DATED : April 29, 2014
INVENTOR(S) : Varani et al.

It is certified that error appears in the above-identified patent and that said Letters Patent is hereby corrected as shown below:

In the Claims:

Column 6, line 57, claim 13;

Change "directly communicating the states of the variable volume storage assembly over time to a compressor control based the detected positions of the variable volume storage assembly;" to –

"directly communicating the states of the variable volume storage assembly over time to a compressor control based on the detected positions of the variable volume storage assembly;"

Signed and Sealed this
Nineteenth Day of August, 2014

Michelle K. Lee

Michelle K. Lee
*Deputy Director of the United States Patent and Trademark Office*